US007645199B2

(12) United States Patent
Cameron

(10) Patent No.: US 7,645,199 B2
(45) Date of Patent: Jan. 12, 2010

(54) PUTTER

(75) Inventor: Don T. Cameron, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 76 days.

(21) Appl. No.: 11/304,642

(22) Filed: Dec. 16, 2005

(65) Prior Publication Data

US 2006/0094535 A1 May 4, 2006

Related U.S. Application Data

(60) Division of application No. 10/636,812, filed on Aug. 8, 2003, now Pat. No. 7,004,849, which is a continuation-in-part of application No. 10/051,007, filed on Jan. 22, 2002, now Pat. No. 6,663,497.

(60) Provisional application No. 60/263,709, filed on Jan. 25, 2001.

(51) Int. Cl.
*A63B 69/36* (2006.01)
*A63B 53/04* (2006.01)

(52) U.S. Cl. ..... 473/249; 473/251; 473/255; 473/313; 473/314; 473/340; 473/341; 473/349

(58) Field of Classification Search ..... 473/324–350, 473/249, 255, 313–314, 251; D21/736–746
See application file for complete search history.

(56) References Cited

U.S. PATENT DOCUMENTS

| | | | |
|---|---|---|---|
| 749,174 | A | 1/1904 | Davis |
| 1,665,523 | A | 4/1928 | Boyce |
| 1,818,359 | A | 8/1931 | Samaras et al. |
| 2,026,749 | A | 1/1936 | Pester |
| 2,138,294 | A | 11/1938 | Douglas |
| 2,175,598 | A | 10/1939 | Fedak |
| 2,305,270 | A | 12/1942 | Nilson |
| 2,451,262 | A | 10/1948 | Watkins |
| 3,477,720 | A | 11/1969 | Saba |
| 3,679,207 | A | 7/1972 | Florian |
| 3,888,492 | A | 6/1975 | Cabot |
| 4,067,572 | A | 1/1978 | Coleman |
| 4,138,117 | A | 2/1979 | Dalton |
| 4,194,739 | A | 3/1980 | Thompson |
| 4,361,329 | A | 11/1982 | Brock |

(Continued)

FOREIGN PATENT DOCUMENTS

| | | |
|---|---|---|
| JP | 08-266695 | 10/1996 |

(Continued)

*Primary Examiner*—Sebastiano Passaniti
(74) *Attorney, Agent, or Firm*—Hanify & King, P.C.

(57) ABSTRACT

A golf putter head adapted for attachment to a club shaft is provided with a face member having a strike face and a cylindrical back cavity, and a body member configured to fit and rotate within the back cavity is disclosed. Selective rotation of the body member within the back cavity sets a loft of the putter head. The weighting of the putter is adjusted by securing a weight member to the body member. A golf putter head having an increased moments of inertia is also disclosed. The putter head includes a face member, a body member, and a weight member. Placement of the weight member is such that the moments of inertia are increased and the putter head is stable.

14 Claims, 8 Drawing Sheets

U.S. PATENT DOCUMENTS 4,693,478 A * 9/1987 Long ..... 473/251
4,754,976 A 7/1988 Pelz
4,778,180 A 10/1988 Guenther
4,836,550 A * 6/1989 Kobayashi ..... 473/350
5,072,941 A 12/1991 Klein
5,230,509 A 7/1993 Chavez
5,244,205 A 9/1993 Melanson et al.
5,275,413 A 1/1994 Sprague
5,390,920 A 2/1995 Nickum
5,431,337 A 7/1995 Bell
5,437,447 A 8/1995 Rigutto
5,470,070 A 11/1995 Bendo
5,529,302 A 6/1996 Rodriguez
5,544,897 A 8/1996 Di Pietro et al.
5,577,726 A 11/1996 Fenton
5,580,058 A 12/1996 Coughlin
5,700,207 A 12/1997 Guthrie et al.
5,709,613 A 1/1998 Sheraw
5,749,790 A 5/1998 Van Alen, II
5,785,608 A 7/1998 Collins
5,863,257 A 1/1999 Busnardo
5,890,969 A 4/1999 Bechler
6,045,453 A 4/2000 Jenkins
6,203,446 B1 3/2001 Collins
6,506,125 B2 1/2003 Helmstetter et al.
D477,041 S 7/2003 Cameron
6,663,497 B2 * 12/2003 Cameron ..... 473/245
D499,778 S * 12/2004 Cameron ..... D21/742
D506,796 S * 6/2005 Li ..... D21/742
D507,613 S * 7/2005 Baiocchi ..... D21/742
6,929,559 B1 * 8/2005 Grace ..... 473/251
6,932,716 B2 * 8/2005 Ehlers et al. ..... 473/329
7,004,849 B2 * 2/2006 Cameron ..... 473/249
7,052,410 B2 * 5/2006 Cameron ..... 473/245
D594,073 S * 6/2009 Kadoya ..... D21/744
2003/0036438 A1 * 2/2003 Tang et al. ..... 473/242

FOREIGN PATENT DOCUMENTS

JP 09-000667 1/1997
JP 09-220302 8/1997

* cited by examiner

PUTTER

CROSS-REFERENCE TO RELATED APPLICATIONS

This is a divisional of U.S. patent application Ser. No. 10/636,812 entitled "Putter," filed on Aug. 8, 2003, now U.S. Pat. No. 7,004,849, which is a continuation-in-part of U.S. patent application Ser. No. 10/051,007 entitled "Adjustable Putter," filed on Jan. 22, 2002, now U.S. Pat. No. 6,663,497, which claims priority from Provisional Patent Application No. 60/263,709, filed Jan. 25, 2001. All of these documents are incorporated herein by reference in their entireties.

BACKGROUND OF THE INVENTION

1. Field of The Invention

The invention relates to an improved golf club construction. More particularly, the invention is related to a putter with adjustable loft and weighting or a putter with a high moment of inertia.

2. Description of the Related Art

The design of putters is typically viewed as a pursuit of an aesthetically pleasing club that promotes a golfer's confidence in his or her stroke. As such, many putters have been designed irrespective of the mechanics inherent in the putting swing. Furthermore, many putters lack a design that accounts for an individual golfer's characteristics and characteristic playing style (i.e., stance, grip, etc.).

The lack of attention to technical details in many putter designs results in clubs that are not aimed or balanced properly. Such technical considerations, for example, include heel and toe weight distribution, location of the putter head's center of gravity or "sweet spot," putter length, shaft flexibility, grip, head weight and total club weight, loft, and lie. Because the USGA Rules of Golf permit significant latitude in the design of putters, i.e., the shaft, neck or socket of a putter may be fixed at any point in the head, many putter designs are possible. And, because significant deviation in the intended path of a putt can be experienced for even slightly off-center hits, careful attention to these design factors can result in a putter that is more likely to perform well in use.

Various adjustable club constructions are known. For example, U.S. Pat. No. 2,305,270 to Nilson discloses a golf club with a hosel that has an extension on which the head is slidably and pivotally mounted. The extension is embedded in a shallow depression in the back of the head and runs substantially the entire length of the head. The head further includes lugs with inner serrated portions, and when a desired angle has been selected for the face, serrated portions on the extension are engaged with the lugs to lock the position.

U.S. Pat. No. 4,778,180 to Guenther discloses a golf club having a reversible head for use either as a putter or chipper, and for use by either a left handed or right handed player. In operation, the head is rotatable by 180° on a pin to present either a chipper face or putter face. A lever with side cam surfaces permits releasable locking of the head in position.

U.S. Pat. No. 4,194,739 to Thompson discloses an adjustable golf putter with a body and a separate putter face that is initially adjustable relative to the body prior to permanent securement. The putter includes an elongated tapered body having a plane of symmetry extending in the direction of the putting motion. The face is rotatably mounted on the head about a pin, and a pair of screws secure the face to prevent rotation. A bubble level is also recessed in the putter face. If the putter face is not level, the golfer loosens the screws, pivots the putter face about the pin to adjust the angle between the upper surface of the putter face and the shaft, and when the bubble level indicates level for the preferred putting stance of the golfer, the screws are tightened. The weight of the putter head is adjustable by disposing cylindrical weight inserts in a bore in the body located behind and perpendicular to the face.

In addition, U.S. Pat. No. 4,067,572 to Coleman discloses a golf club with a hollow main body, thereby providing a chamber into which liquid or granular weighting material may be placed. The main body is preferably spherical, and a movable, disc-shaped face portion is provided on its rear with a portion that is contoured to complement the spherical shape of the body. A clamping member and retaining bolt are provided; loosening the bolt permits the club face portion to be repositioned through an arc of 360°, while tightening the bolt fixes the face portion in the desired position.

Despite these developments, there exists a need for an improved putter construction. In particular, there is a need for an improved putter with adjustable loft and weighting and there is a need for an improved putter with a high moment of inertia.

SUMMARY OF THE INVENTION

The present invention is related to a golf putter head adapted for attachment to a club shaft. The head includes a face member having a strike face and a cylindrical back cavity, and a body member configured to fit and rotate in at least one plane or direction within the back cavity. Selective rotation of the body member within the back cavity sets a loft of the putter head. In one embodiment, a weight member is coupled to the body member, and is symmetrically disposed about a longitudinal center of the body member. The weight member may have a generally arcuate shape and may be disposed on the back portion of the body member.

The back cavity of the face member may include two recessed wing portions and a recessed generally cylindrical portion disposed therebetween, while the body member may include a front portion with a generally cylindrical projecting portion and a cylindrical passage extending parallel therethrough. The front portion of the body member further includes opposing sections separated by a slit that extends along the length of the cylindrical passage, the opposing sections being connected by a threaded hole. Threadable engagement of a fastener in the threaded hole changes the separation of the opposing sections.

A generally cylindrical insert is configured and dimensioned to be received within the cylindrical passage of the body member, with the insert further including a base portion configured to be received in fixed orientation within the wing portions.

The body member may be generally rectangular and have a side flange with a bore therein, the bore being configured and dimensioned to receive the shaft. The body member also may include a front portion, a back portion, and a pair of sides, the sides each having a lower edge with at least two edge portions that are crooked with respect to each other at an angle of between about 0° and about 30°.

The present invention is further related to a golf putter head adapted for attachment to a club shaft. The putter head includes a face member having a strike face and a back cavity, the back cavity including at least one keyway portion, and a body member configured to fit and rotate in at least one plane or direction within the back cavity, the body member including a passage therein. In addition, the putter head includes an insert configured to fit and rotate in at least one plane or direction within the passage, the insert including at least one keyed portion. When the keyed portion is disposed in the keyway portion, selective rotation of the body member about the insert sets a loft of the putter head.

The present invention is also related to a golf putter head, adapted for attachment to a club shaft, having a high moment of inertia. The putter head comprises a face member, a body member, and a weight member. The face member has a strike face and a rear surface opposite the strike face. The body member has a first end and a second end. The body member first end is coupled to the face member rear surface. The weight member is coupled to the body member second end.

The weight member has a first weight, and the club head has a second weight. The first weight is preferably at least 25% of the second weight. More preferably, the first weight is at least 50% or 75% of the second weight. The weight member may be curved toward said face member, and ends of the weight member are from 0 inch to approximately 1.5 inches from the strike face. Alternatively, the ends of the weight member may contact the face member.

The putter head contains a shaft mount for connecting a shaft to the club head. The shaft mount preferably is offset from the face member such that the shaft attaches close to the club head center of gravity. The body member preferably comprises the shaft mount, either coupled thereto or as an integral part thereof. The shaft may be bent to give it a straight, no offset appearance at address. The shaft mount is preferably positioned a distance of approximately 1.5 inches to approximately 2 inches from the strike face. Alternatively, the shaft mount is preferably positioned between the midpoint of the putter head length and the strike face, and more preferably is positioned a distance of approximately 25% of the putter head length to approximately 50% of the putter head length behind the strike face. The club head center of gravity is preferably located a distance of approximately 1 inch to 4 inches from the strike face. More preferably the center of gravity is approximately 1.5 inches to approximately 2 inches from the strike face, and most preferably approximately 1.7 inches from the strike face. Alternatively, the center of gravity is preferably located between the midpoint of the club head length and the weight member. Alternatively, the center of gravity is located a distance of approximately 50% of the club head length to approximately 75% of the club head length behind the strike face.

The body member preferably is coupled to the face member in a substantially perpendicular fashion such that the putter has a "T-frame" shape. The face member preferably is coupled to the body member such that the face member is lower than the body member. This will help reduce grounding of the club during the swing. The face member leading edge may be beveled for the same reason. The club head is balanced such that it is stable when placed on a substantially flat surface.

A measure of the putter head moment of inertia about a vertical axis passing through the club head center of gravity preferably is greater than approximately 550 kg·mm$^2$. More preferably, the moment of inertia is within a range of approximately 600 kg·mm$^2$ to approximately 800 kg·mm$^2$, and most preferably is within a range of approximately 700 kg·mm$^2$ to approximately 750 kg·mm$^2$.

The moment of inertia of the club head as measured about a vertical axis passing through the shaft mount preferably is greater than approximately 550 kg·mm$^2$. More preferably, the moment of inertia is within a range of approximately 600 kg·mm$^2$ to approximately 900 kg·mm$^2$, and most preferably is within a range of approximately 800 kg·mm$^2$ to approximately 850 kg·mm$^2$.

The moment of inertia of the club head as measured about a longitudinal axis of the body member preferably is greater than approximately 350 kg·mm$^2$. More preferably, the moment of inertia is within a range of approximately 400 kg·mm$^2$ to approximately 600 kg·mm$^2$, and most preferably is within a range of approximately 500 kg·mm$^2$ to approximately 550 kg·mm$^2$.

The face member preferably comprises aluminum. The body member preferably comprises aluminum. The weight member preferably comprises steel.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENT

Figure 1:
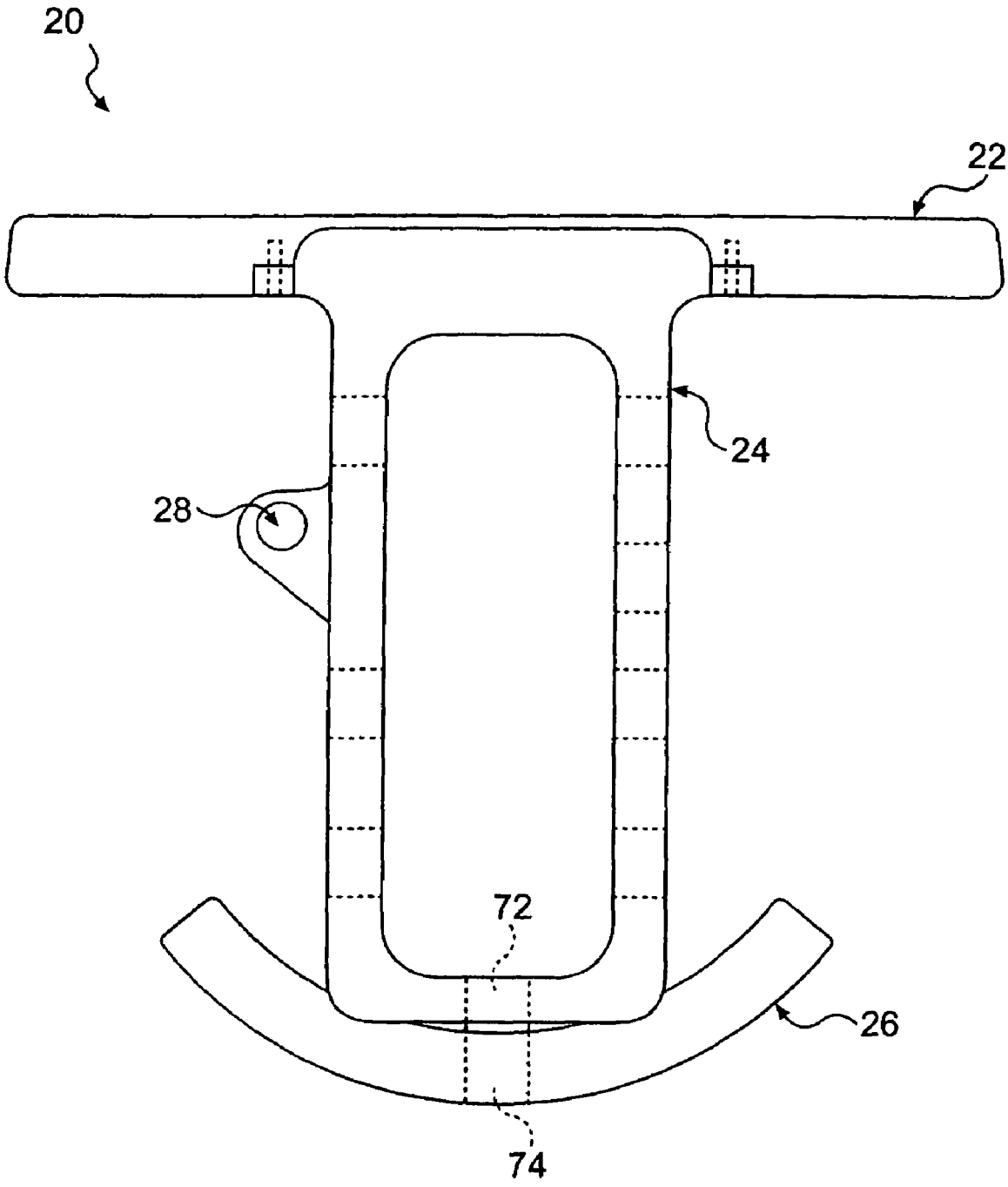
FIG. 1 shows a top view of a putter head according to the present invention with back weighting.

Referring to FIGS. 1-10, the putter construction according to the present development is shown. Putter head 20 includes a face member 22, a body member 24, and a back weight member 26, each of which are secured together as will be discussed. A shaft bore 28 is provided for attachment of putter head 20 to a club shaft.

Figure 2:
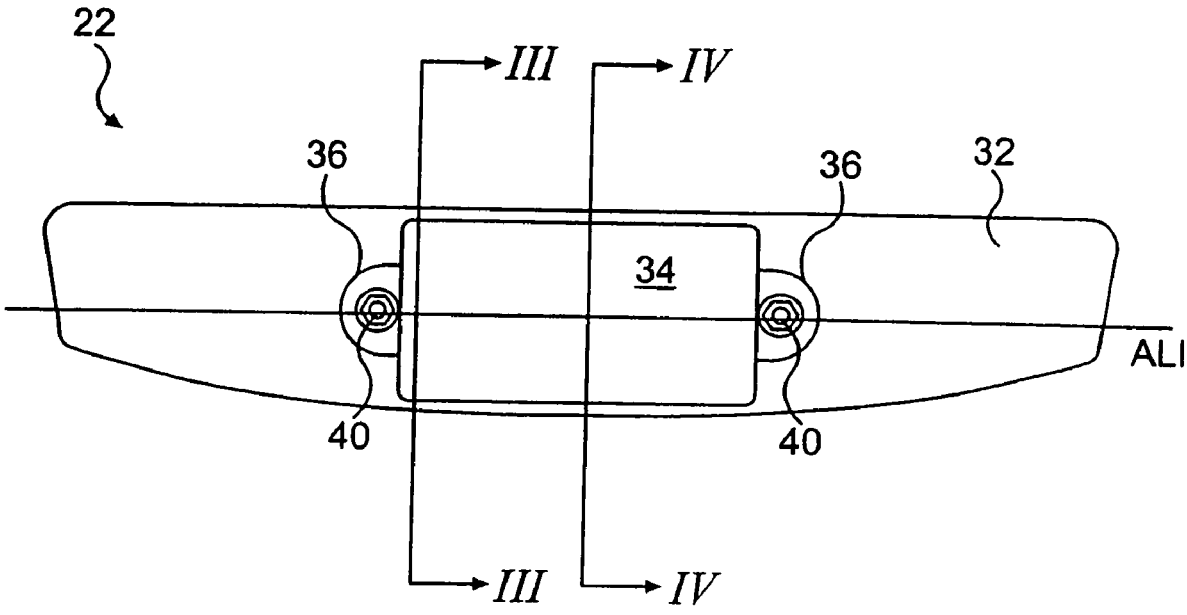
FIG. 2 shows a back view of a face member for a putter head according to the present invention with a cavity therein.
Figure 3:
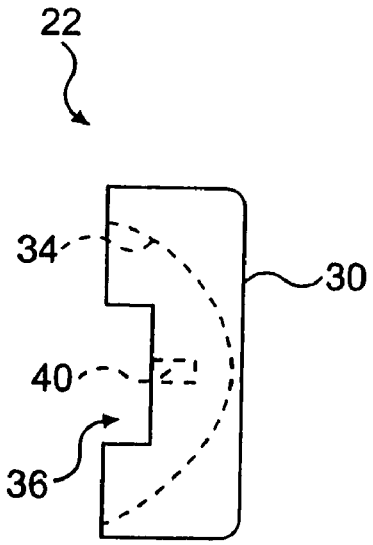
FIG. 3 shows a cross-section of the face member of FIG. 2 taken along line III-III.
Figure 4:
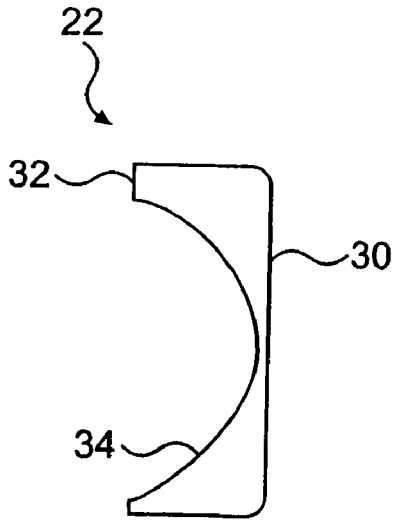
FIG. 4 shows a cross-section of the face member of FIG. 2 taken along line IV-IV.

As shown in FIGS. 2-4, face member 22 has a generally flat ball-striking front portion 30 and a back portion 32. A recessed region or back cavity 34 is formed in back portion 32, and preferably has a generally cylindrical contour. A pair of recessed wing portions 36 are formed at opposite ends of back cavity 34, creating a keyway that preferably has a depth less than the maximum depth of back cavity 34. A hole 40 is formed in each wing portion 36 for receiving a threaded fastener. Preferably, back cavity 34 is substantially symmetric about line ALI, which is also generally parallel to the ground.

Figure 5:
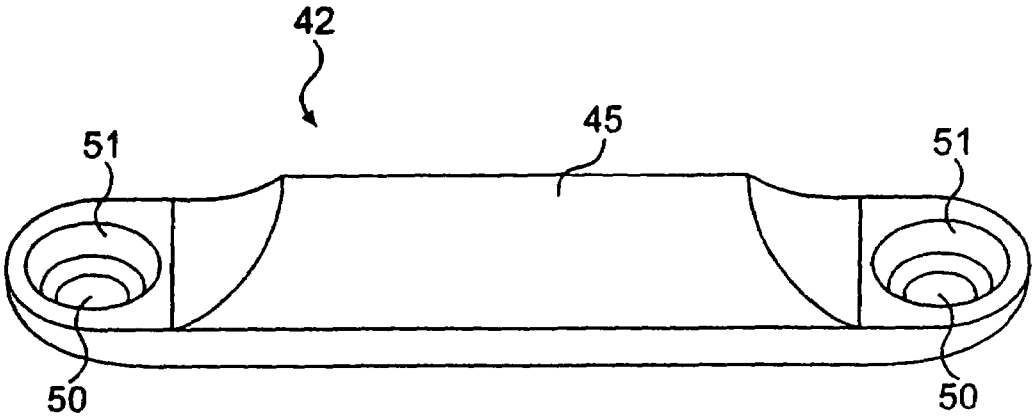
FIG. 5 shows a bottom, perspective view of an insert member for a putter head according to the present invention.
Figure 6:
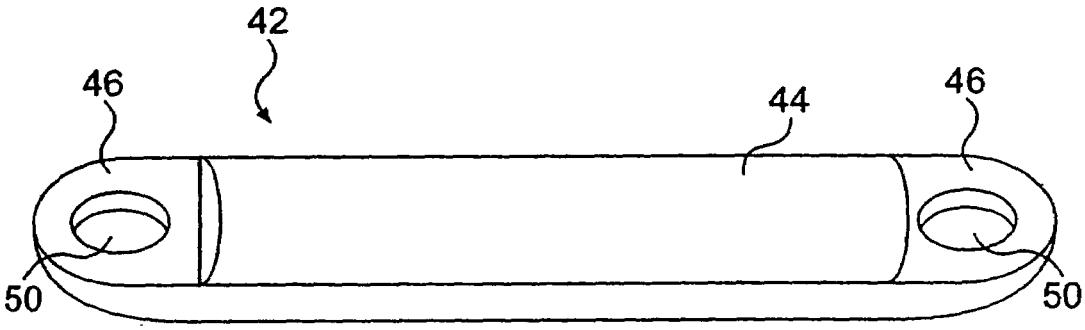
FIG. 6 shows a top, perspective view of the insert member of FIG. 5.
Figure 7:
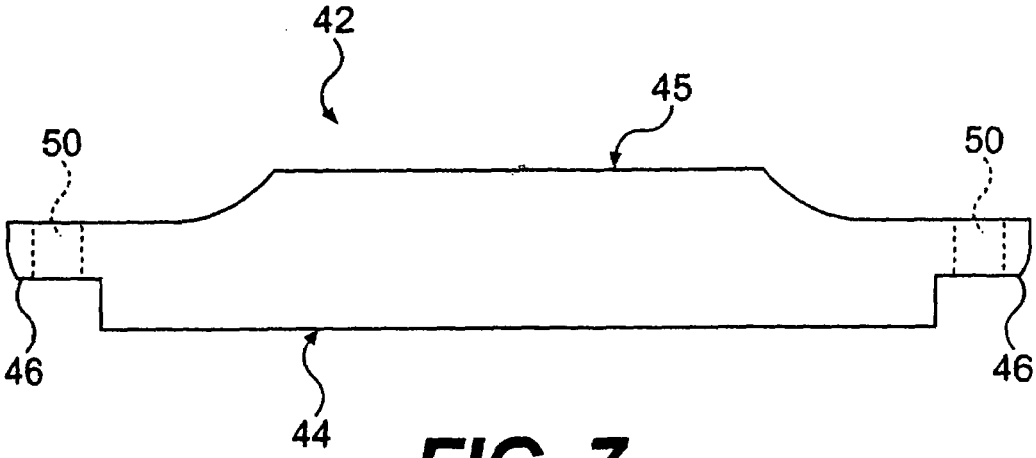
FIG. 7 shows a side view of the insert member of FIG. 5.

Turning to FIGS. 5-6, in one embodiment of the present invention, an insert 42 is provided for coupling body member 24 to face member 22. Insert 42 includes a central, generally cylindrical projecting portion 44, along with a base portion 46 which creates a keyed portion that is adapted to be received within wing portions 36 of back cavity 34 of face member 22. A generally cylindrical, tapered portion 45 is also provided, and serves as a further keyed region for aiding in insertion of insert member 42 into body member 24. More particularly, the overall longitudinal geometry of insert 42 is cylindrical, such that it can rotate in at least one plane or direction within body member 24 as will be described shortly. Base portion 46 includes a pair of holes 50, which preferably include recessed portions 51 so that the head of a screw or other fastener may be recessed therein.

The loft of the putter is defined as the angle of the face and a line perpendicular to the sole line measured to a point that is half of the distance of the face height and located on the center of the face. In order to provide adjustment of the loft, the angle of body member 24 related to face member 22 is adjusted by rotation within cylindrical back cavity 34 of face member 22. With an insert member 42 disposed in body member 24, and with base portion 46 disposed within wing portions 36, the loft may be changed to a suitable amount.

Figure 8:
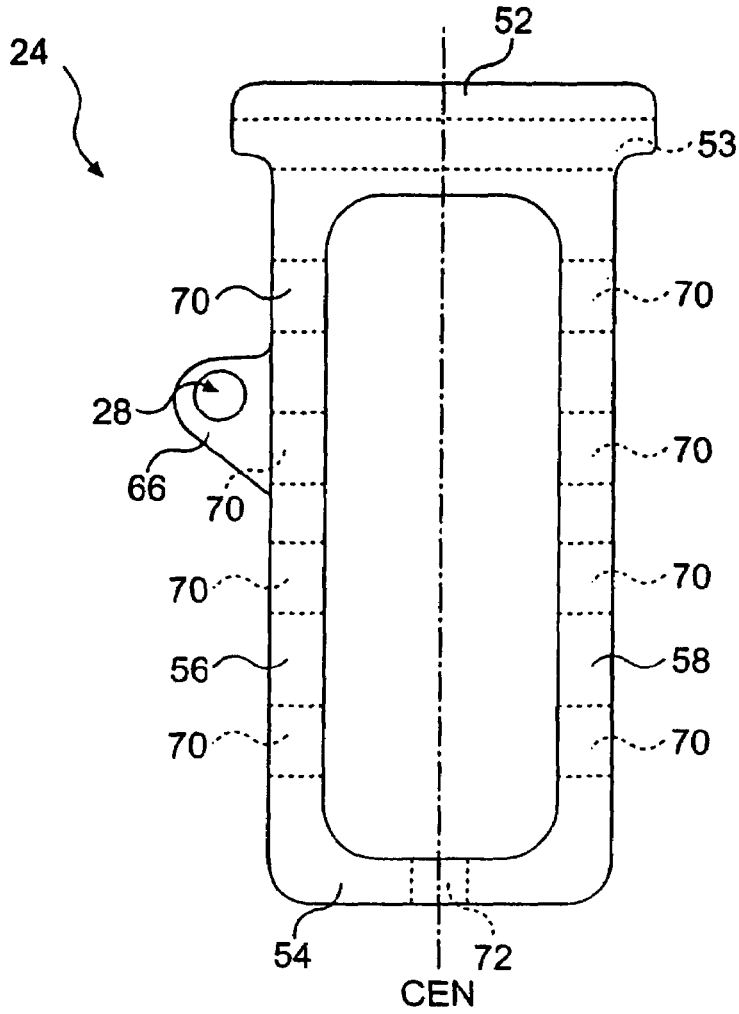
FIG. 8 shows a top view of a body member for a putter head according to the present invention.
Figure 9:
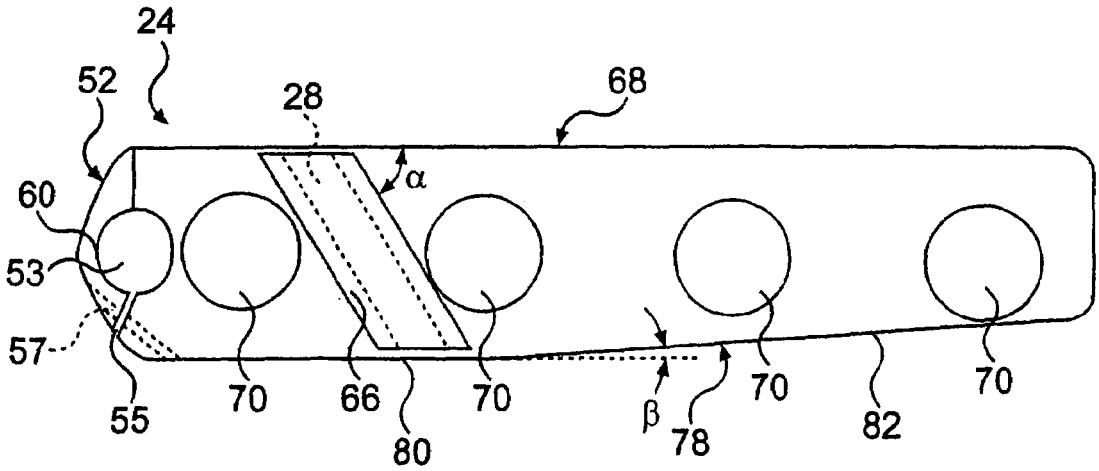
FIG. 9 shows a side view of the body member of FIG. 8.
Figure 10:
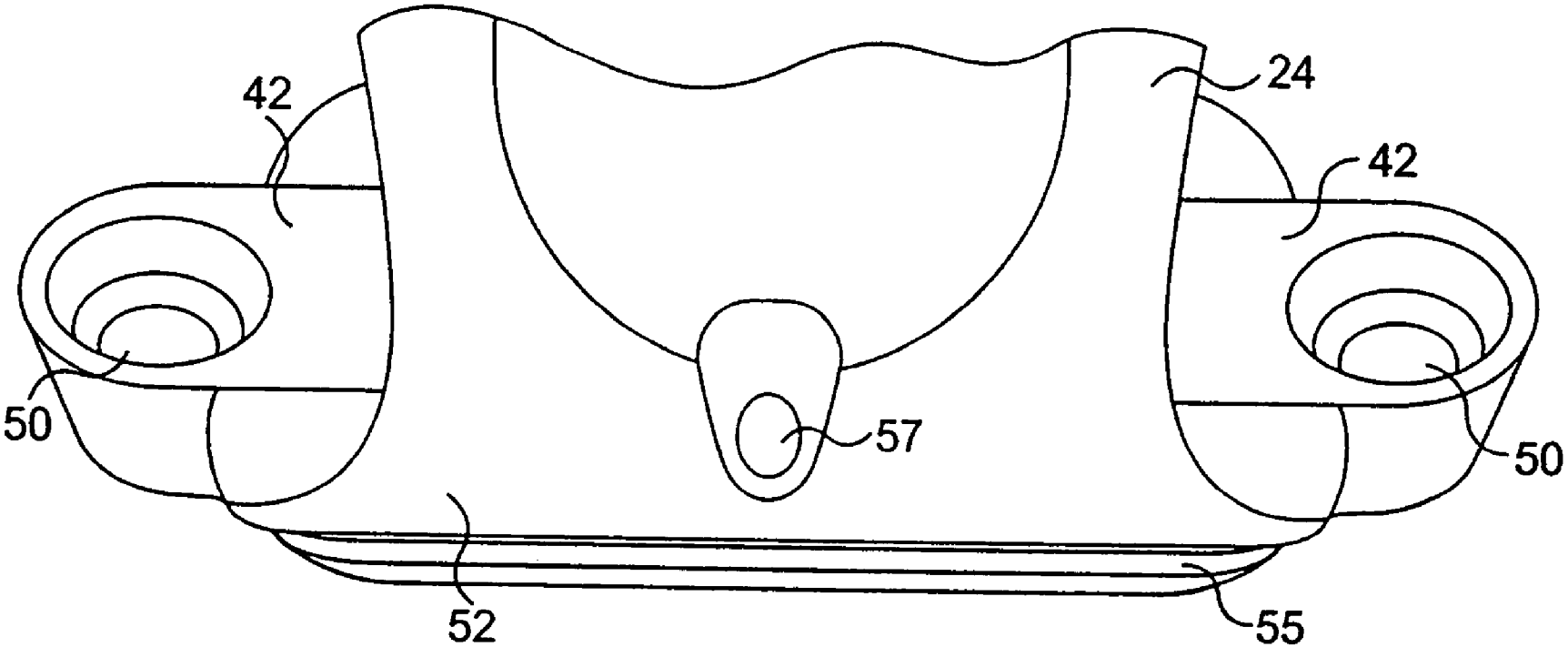
FIG. 10 shows a partial perspective view of the body member according to the present invention with an insert member housed therein.

More particularly, with reference to FIGS. 8-10, body member 24 is generally rectangular and hollow, and includes cylindrical front portion 52, back portion 54, and side portions 56, 58. Front portion 52 receives an insert member 42 in cylindrical passage 53. Front portion 52 further includes a slit 55 extending along the length of cylindrical passage 53, and thus providing a loose fit of insert member 42 when placed in cylindrical passage 53, which runs parallel to line ALI when front portion 52 contacts back cavity 34. During setting of the desired loft, body member 24, with an insert member 42 housed in passage 53, is loosely coupled to face member 22. With the insert member 42 resting in wing portions 36, the body member 24 may be rotated with respect to face member 22; the body member rotates about insert member 42, which is fixed in location and angle with respect to face member 22. When a desired loft has been set, the insert member 42 may be tightly coupled to face member 22 using screws or other fasteners, which extend through holes 50, 40 in insert member 42 and face member 22, respectively. In addition, the rotation of body member 24 with respect to insert member 42 may be arrested through the use of a threaded fastener that extends through threaded hole 57 and connects opposing portions of front portion 52 separated by slit 55. When the fastener is tightened, the separation between these portions may be decreased such that the gap provided by slit 55 is closed. In turn, the diameter of passage 53 is slightly decreased, locking insert member 42 in place.

A side flange 66 is provided on a side 56, 58, depending on whether the golfer is right-handed or left-handed. A shaft bore 28 for receiving a club shaft extends at least partway through flange 66, which is oriented at an angle $\alpha$ with respect to a flat edge 68 of body member 24. Preferably, angle $\alpha$ is between about 5° and about 85°. The desired loft may be set by rotating body member 24 with respect to face member 22.

As shown in FIG. 9, edge 68 is disposed opposite an edge 78 of body member 24. Edge 78 includes straight potions 80, 82 which are crooked with respect to each other. Preferably, straight potions 80, 82 are disposed at an angle $\beta$ between about 0° and about 30°.

Body member 24 also includes bores 70 through side walls 56, 58. Weight removed from side walls 56, 58 due to the presence of bores 70 may be redistributed in putter head 20, such as with back weight member 26 as shown in FIG. 1. Further to this end, a hole 72 is provided in back portion 54 of body member 24 so that back weight member 26 with a similarly disposed hole 74 may be secured thereto, as with a fastener such as a screw. More than one hole 74 may be provided so that several fasteners may be used. Preferably, back weight member 26 is generally arcuate in shape, and is symmetrically disposed with respect to line CEN along the longitudinal center of body member 24. Back weight member 26 may further include a central recessed region, so as to conform to the geometry of body member 24.

Figure 11:
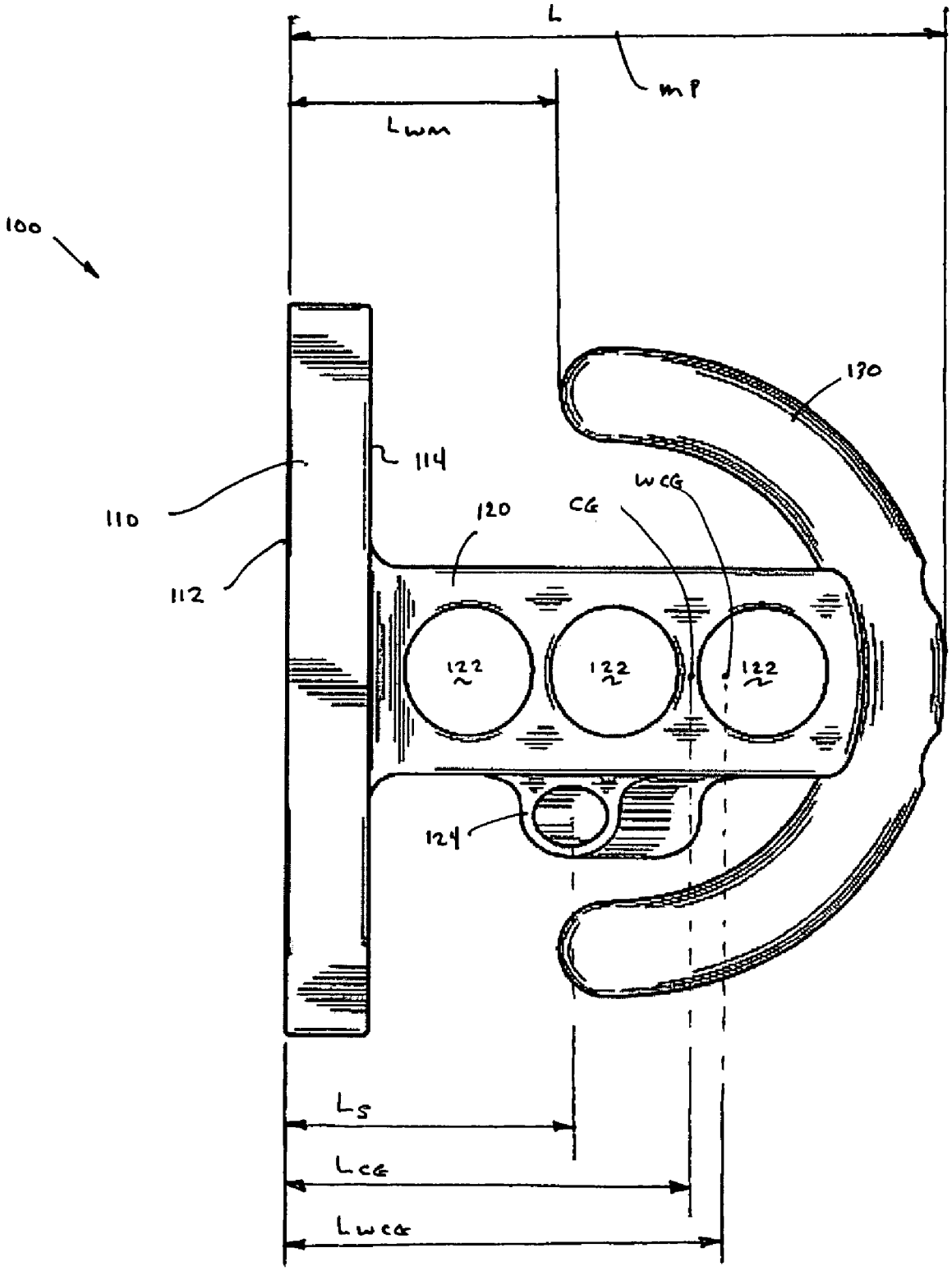
FIG. 11 shows a top view of another putter head of the present invention.
Figure 12:
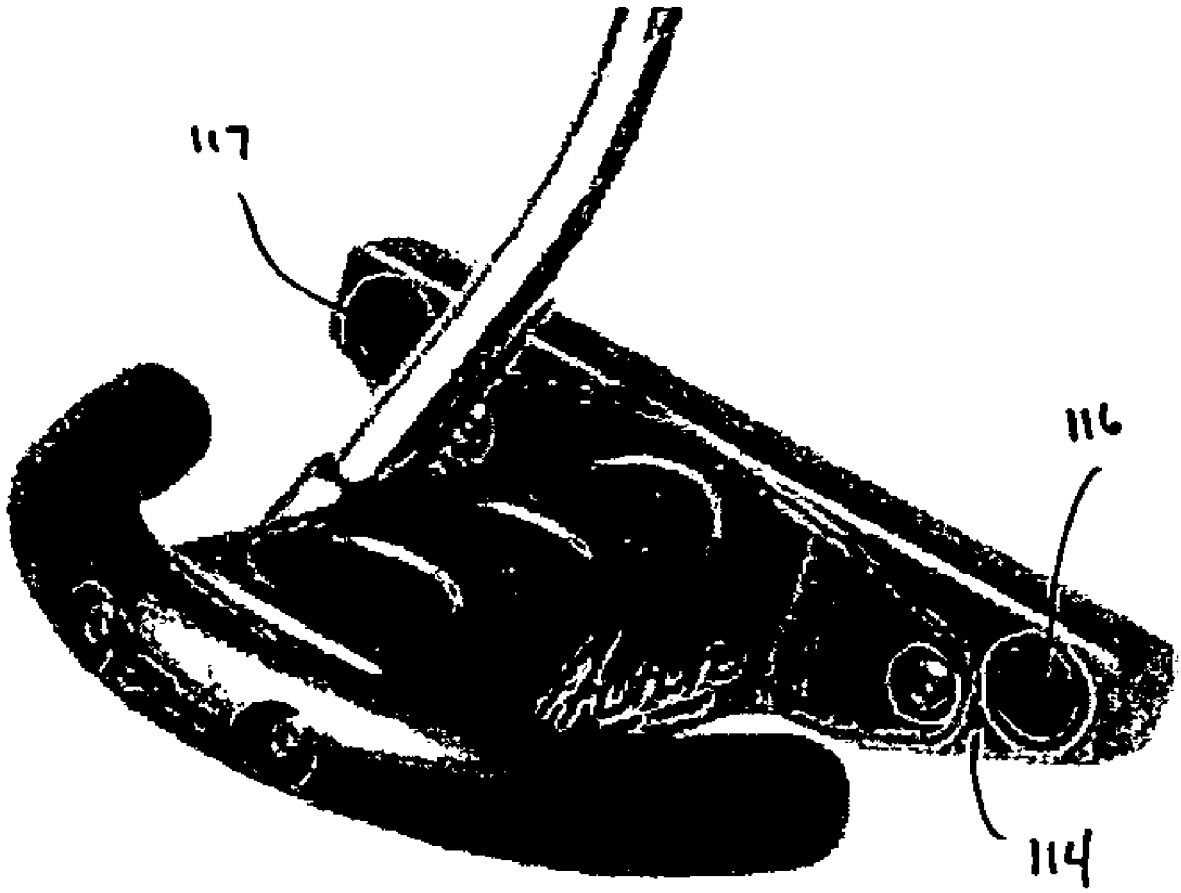
FIG. 12 shows a rear view of the putter head of FIG. 11.
Figure 13:
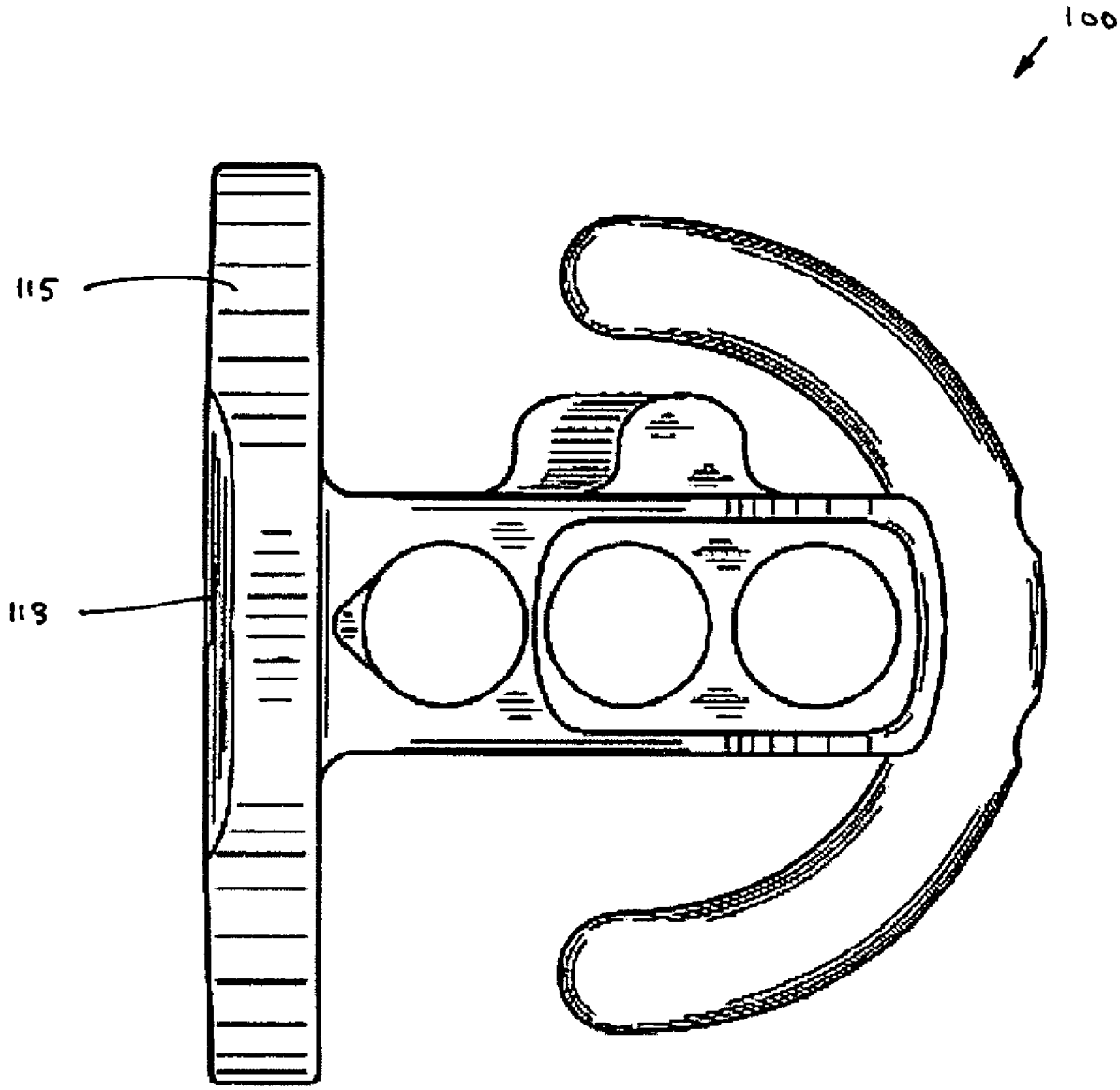
FIG. 13 shows a bottom view of the putter head of FIG. 11.

FIG. 11 shows a top view of another putter head 100 of the present invention. FIG. 12 shows a rear view of putter head 100. FIG. 13 shows a bottom view of the putter head 100. Club head 100 is designed to have a high moment of inertia MOI. Putter head 100 includes a face member 110, a body member 120, and a weight member 130.

Face member 110 is elongate, with the length being greater than the width. The width of face member 110 may be substantially uniform along its length (there may be an inset for seating body member 120). Face member 110 has a generally flat ball-striking front surface 112, a rear surface 114, and a bottom surface 115. Rear surface 114 may contain holes 116 for inserting weights 117. Preferably, there is a hole 116 and a weight 117 toward each end of rear surface 114. Face member 110 is preferably made of aluminum.

Front surface 112 has a leading edge 113. Leading edge 113 is preferably beveled to create a smooth transition between face surface 112 and bottom surface 115. Beveling reduces the likelihood of snagging the club on the ground, or "grounding" the club, during a putting stroke. Bottom surface 115 may also be angled at ends thereof to further reduce the likelihood of grounding the club in the event of a toe-up or toe-down stroke.

Face member 110 has a loft angle within a range of approximately 0° to approximately 10°. As used herein, "within a range" includes the end values. Face member 110 preferably has a loft angle of approximately 4° or less with shaft 140 in the vertical position. A 4° loft angle has been determined the ideal loft angle for a putting stroke. See the inventor's U.S. patent application Ser. No. 09/156,540, now pending and which is incorporated herein by reference, for further discussion regarding putter loft angle. The presence of weight member 130 and the location of the club head center of gravity CG behind face member 110 creates a dynamic loft angle effect, which causes the ideal loft angle to be less than 4°. The loft angle preferably is approximately 3.5° or less, and more preferably is approximately 3° or less. This angle may be varied according to the needs of the individual user. For example, if the user has a 2° forward press, face member 110 will be designed with a loft angle of 2° greater, resulting in the proper dynamic loft angle during use. Likewise, if the user has a rearward press, the loft angle of face member 110 can be reduced to produce the proper dynamic loft angle.

Body member 120 is coupled to rear surface 114 and extends away from rear surface 114 in a substantially perpendicular fashion. Body member 120 has a length and a width, the length being greater than the width. In a preferred embodiment, the length of club head 100 is substantially the same as the length of face member 110. Body member 120 is coupled to face member 110 such that face member 110 is slightly lower than body member 120. This encourages proper contact between strike surface 112 and the ball, and further minimizes the likelihood of grounding the club during the swing. Body member 120 is preferably made of aluminum.

The illustrated embodiment of body member 120 contains a plurality of holes 122 to reduce its weight. This gives body member 120 the appearance of having rails, and helps to increase the MOI, as discussed below. In an alternative embodiment, body member 120 contains no holes.

Body member 120 contains shaft mount 124 for connecting a shaft 140 to club head 100. Shaft mount 124 may be positioned toward a side of body member 120 as shown in the figures, or it may be formed within the rectangular frame of body member 120. For example, shaft 140 may be coupled to body member 110 within one of holes 122. Shaft mount 124 is positioned behind face member 110 approximately at the midpoint along the length of body member 110. This location, which is near the club head center of gravity CG, provides for a more flowing stroke. Shaft mount 124 may be positioned a distance $L_S$ behind strike face 112. Distance $L_S$ is preferably approximately 1.5 inches to approximately 2 inches. Club head 100 has a length L having a midpoint MP. Shaft mount 124 may alternatively be positioned between midpoint MP and strike face 112, and more preferably is positioned a distance of approximately 25% of putter head length L to approximately 50% of putter head length L behind strike face 112.

Shaft 140 may preferably by bent to give a straight, no offset appearance at address. Shaft 140 is preferably coupled to produce a 71° lie angle. Shaft 140 may be of any standard length, including a length of approximately 35 inches or more. Alternate preferable lengths for shaft 140 include approximately 37 inches and approximately 53 inches.

Face member 110 and body member 120 are coupled to form a "T-frame" shape. In addition to increasing MOI, as discussed below, the T-frame allows for improved accuracy. During the putting stroke, body member 120 provides the user with a visual alignment of the putt. Any slight misalignment of club head 100 that may likely go unnoticed with a traditional putter may be readily apparent via the T-frame design of club head 100. By aligning elongate body member 120 with the intended ball path, the user can ensure the putter is aligned as desired. By doing so, the user is more likely to hit the intended shot.

Weight member 130 is coupled to body member 120 at the opposite end from face member 110. This placement of weight member 130 increases the MOI of club head 100. Inertia is a property of matter by which a body remains at rest or in uniform motion unless acted upon by some external force. MOI is a measure of the resistance of a body to angular acceleration about a given axis, and is equal to the sum of the products of each element of mass in the body and the square of the element's distance from the axis. Thus, as the distance from the axis increases, the MOI increases. By placing weight member 130 at the distal end of body member 120 relative to face member 110, MOI can be significantly increased without substantially altering the overall weight of club head 100. This MOI increase is greater than that possible with heel-to-toe weighting of conventional putters, due to operational weight limits. When a club, such as a putter, strikes a ball off-center, there is a tendency for the club to rotate about a vertical axis passing through the club head center of gravity CG. This club rotation causes the shot or putt to deviate from the intended course by either a push/pull (straight ball path), slice/hook (curved ball path), or combination thereof. Increasing the MOI about this axis, such as through use of weight member 130, increases the resistance to club head rotation and creates more accurate off-center shots.

During an ideal putting stroke, the putter head is not rotated. That is, face member 1 10 is kept substantially perpendicular to the intended putt path. During actual putting strokes, however, golfers frequently rotate the putter about a vertical axis, resulting in the ball being sent awry. Increasing the MOI about the vertical axis passing through club head center of gravity CG also helps prevent this unintended and undesired rotation of club head 100.

Club head 100 has a center of gravity CG. Center of gravity CG is the point at which the entire weight of club head 100 may be considered as concentrated. This is also the point through which club head 100 will rotate if a force not passing through center of gravity CG is exerted thereon. Moving center of gravity CG away from strike face 112 increases the MOI and stability of club head 100. Center of gravity CG is preferably located a distance $L_{CG}$ behind strike face 112. Distance $L_{CG}$ preferably is approximately 1 inch to 4 inches. More preferably distance $L_{CG}$ is approximately 1.5 inches to approximately 2 inches, and most preferably distance $L_{CG}$ is approximately 1.7 inches. Center of gravity CG is preferably between midpoint MP and weight member 130. Center of gravity CG is preferably located a distance of approximately 50% of length L to approximately 75% of length L behind strike face 112. Shaft mount 124 is preferably positioned between midpoint MP and strike face 112, and more preferably is positioned a distance of approximately 25% of length L to approximately 50% of length L behind strike face 112. Club head 100 has a weight. Approximately 50% of the weight to approximately 75% of the weight is located on a weight member side of shaft mount 124. This positioning of center of gravity CG and shaft mount 124, along with the weights of face member 110, body member 120, and weight member 130, give club head 100 a MOI as measured about a vertical axis passing through center of gravity CG that is preferably greater than approximately 550 $kg \cdot mm^2$. More preferably, the moment of inertia is within a range of approximately 600 $kg \cdot mm^2$ to approximately 800 $kg \cdot mm^2$, and most preferably is within a range of approximately 700 $kg \cdot mm^2$ to approximately 750 $kg \cdot mm^2$.

An off-center hit may also tend to make club head 100 rotate about shaft mount 124. That is, the club tends to rotate about shaft 140. The placement of weight member 130, however, also tends to increase the MOI about shaft mount 124 more than is possible with heel-to-toe weighting of conventional putters. The MOI of club head 100 as measured about a vertical axis passing through shaft mount 124 preferably is greater than approximately 550 $kg \cdot mm^2$. More preferably, the moment of inertia is within a range of approximately 600 $kg \cdot mm^2$ to approximately 900 $kg \cdot mm^2$, and most preferably is within a range of approximately 800 $kg \cdot mm^2$ to approximately 850 $kg \cdot mm^2$.

Another common problem resulting in misaligned putts is rotation of the club head through a horizontal axis substantially perpendicular to face member 110. That is, about an axis collinear with the intended path of the putt. This toe-up or toe-down misalignment frequently occurs during the putting stroke. The position of weight member 130 and its arcuate design increase the MOI about the horizontal axis. Club head 100 preferably has a MOI as measured about a longitudinal axis of body member 120 that is preferably greater than approximately 200 $kg \cdot mm^2$. More preferably, the moment of inertia is within a range of approximately 200 $kg \cdot mm^2$ to approximately 400 $kg \cdot mm^2$, and most preferably is within a range of approximately 250 $kg \cdot mm^2$ to approximately 300 $kg \cdot mm^2$.

Weight member 130 also helps produce more accurate results for on-center shots by helping the user "swing through" the ball rather than decelerating or "slapping" the ball. Since weight member 130 is separated from strike surface 112 by body member 120, weight member 130 will be traveling downward (i.e., working with gravity) when club head 100 strikes the ball. This results in a smoother putting stroke, and a more accurate shot.

Placing weight member 130 further towards the rear of club head 100 increases the MOI, but also has the undesired effect of increasing instability. If weight member 130 is placed too far away from face member 110, the club head can become "tipsy." That is, placing weight member 130 too far back may cause club head 100, when the club is placed on a level surface, to tilt backward. Thus, club head 100 must be designed to simultaneously maximize MOI and ensure adequate stability.

One way to achieve this balance is by using the proper ratio of the weight of weight member 130 to the overall weight of club head 100. Weight member 130 preferably comprises at least 25% of the entire weight of club head 100. More preferably, weight member 130 comprises at least 50% or at least 75% of the entire weight of club head 100. Weight member 130 is preferably made of steel, which has a greater density than aluminum. In a preferred embodiment, weight member 130 has a weight within a range of approximately 10 g to approximately 200 g, and more preferably within a range of approximately 125 g to approximately 170 g. The overall weight of club head 100 preferably is within a range of approximately 200 g to approximately 600 g, and more preferably within a range of approximately 300 g to approximately 500 g. Alternatively, the overall weight of club head 100 may be similar to the weight of conventional club heads.

Stability of club head 100 is also increased by weights 117 in face member 110. Stability may also be increased by bending weight member 130 such that its ends are curved toward face member 110, as shown in the figures. The illustrated horseshoe shape moves the center of gravity WCG of weight member 130 forward, toward face member 110, and provides a pleasing appearance for club head 100. Weight member 130 is symmetrically disposed about body member 120. The ends of weight member 130 may be curved forward to any desired amount, including such that it contacts face member 110. The ends of weight member are preferably bent such that they are a distance $L_{WM}$ from strike face 112. Distance $L_{WM}$ is preferably from 0 inch to approximately 1.5 inches, and more preferably from 0 inch to approximately 1 inch. Extending the ends of weight member 130 to face member 110 gives club head 100 a mallet-like appearance, which may be desirable to some golfers. In a preferred embodiment, weight member 130 has a circular cross section. Center of gravity WCG is located behind center of gravity CG, and is a distance $L_{WCG}$ from strike face 112. Distance $L_{WCG}$ is preferably from 0 inch to approximately 3 inches.

While various descriptions of the present invention are described above, it should be understood that the various features can be used singly or in any combination thereof. Therefore, this invention is not to be limited to only the specifically preferred embodiments depicted herein.

Further, it should be understood that variations and modifications within the spirit and scope of the invention may occur to those skilled in the art to which the invention pertains. For example, in an alternate embodiment, the mating portions of face member 22 and body member 24 may include a series of facets along a generally cylindrical shape, instead of smooth cylindrical surfaces. Such facets may provided a more positive engagement of the components during fitting. In addition, in another embodiment, body member 24 may be secured to face member 22 without an insert member 42. Front portion 52 of body member 24 may be provided with projections that mate with wing portions 36 in face member 22. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A golf club head, comprising:

a face member having a strike face and a rear surface opposite said strike face;

a body member having a first end and a second end, said body member being coupled at said first end to said face member rear surface; and a weight member coupled to said body member second end; wherein:

the club head includes a center of gravity; and the club head has a moment of inertia as measured about a vertical axis passing through said center of gravity that is greater than 550 $kg \cdot mm^2$; and the club head has a second moment of inertia as measured about a longitudinal axis passing through said center of gravity that is greater than approximately 200 $kg \cdot mm^2$;

wherein said weight member has two ends and a central portion intermediate said ends, said weight member coupled to said body member second end along said weight member central portion, said weight member ends being nearer said face member than said central portion is to said face member.

2. The golf club head of claim 1, wherein said first moment of inertia is within a range of approximately of 600 $kg \cdot mm^2$ to 800 $kg \cdot mm^2$.

3. The golf club head of claim 2, wherein said first moment of inertia is within a range of 700 $kg \cdot mm^2$ to 750 $kg \cdot mm^2$.

4. The golf club head of claim 1, wherein said center of gravity is located a distance of approximately 1.5 inches to approximately 2 inches from said strike face.

5. The golf club head of claim 4, wherein said center of gravity is located a distance of approximately 1.7 inches from said strike face.

6. The golf club head of claim 1, wherein the club head is a putter head.

7. A golf club head, comprising:

a face member having a strike face and a rear surface opposite said strike face;

a body member having a first end and a second end, said body member being coupled at said first end to said face member rear surface; and a weight member coupled only to said body member second end; wherein:

said body member includes a longitudinal axis; and the club head has a moment of inertia as measured about said longitudinal axis that is greater than approximately 200 $kg \cdot mm^2$;

wherein the club head includes a center of gravity and said longitudinal axis passes through said center of gravity;

wherein said weight member has two ends and a central portion intermediate said ends, said weight member coupled to said body member second end along said weight member central portion, said weight member ends being nearer said face member than said central portion is to said face member.

8. The golf club head of claim 7, wherein the club head has a moment of inertia as measured about a vertical axis passing through said center of gravity within a range of approximately of 600 $kg \cdot mm^2$ to 800 $kg \cdot mm^2$.

9. A golf club head, comprising:

a face member having a strike face and a rear surface opposite the strike face;

a body member having a first end and a second end, the body member being coupled at the first end to the face member rear surface; and a weight member coupled only to the body member second end, wherein the club head has a length L extending from the strike face to the weight member, wherein the club head includes a center of gravity, wherein the club head has a first moment of inertia as measured about a vertical axis passing through the center of gravity that is greater than 550 kg·mm$^2$, and wherein the club head has a second moment of inertia as measured about a longitudinal axis passing through the center of gravity that is greater than approximately 200 kg·mm$^2$;

wherein the weight member comprises first and second ends and a central portion intermediate the first and second ends, wherein the weight member is coupled to the body member second end along the weight member central portion with the first and second ends being nearer the face member than the central portion is to the face member.

10. The golf club head of claim 9, wherein the body member comprises a plurality of holes between the first end and second end.

11. The golf club head of claim 9, wherein the center of gravity is located a distance approximately 50 percent to 75 percent of the length L.

12. The golf club head of claim 9, wherein the center of gravity is between a midpoint of length L and the weight member.

13. The golf club head of claim 12, wherein the club head further comprises a shaft, and wherein the shaft is positioned between a midpoint of length L and the strike face.

14. The golf club head of claim 9, wherein the first moment of inertia is between 600 kg·mm$^2$ and 800 kg·mm$^2$.

* * * * *